US005269437A

United States Patent [19]

Gygax

[11] Patent Number: 5,269,437

[45] Date of Patent: Dec. 14, 1993

[54] RETORTABLE PLASTIC CONTAINERS

[75] Inventor: Ralph A. Gygax, Westerville, Ohio

[73] Assignee: Abbott Laboratories, Abott Park, Ill.

[21] Appl. No.: 976,754

[22] Filed: Nov. 16, 1992

[51] Int. Cl.[5] ..... B65D 1/02

[52] U.S. Cl. ..... 220/606; 220/608; 215/1 C

[58] Field of Search ..... 220/604, 606, 608, 609; 215/1 C

[56] References Cited

U.S. PATENT DOCUMENTS 4,231,483 11/1980 Dechennz et al. ..... 220/608
4,978,015 12/1990 Walker ..... 220/608
5,071,015 12/1991 Kinslow ..... 220/606
5,072,841 12/1991 Okhai ..... 220/608

*Primary Examiner*—Joseph Man-Fu Moy

*Attorney, Agent, or Firm*—Lonnie R. Drayer; Donald O. Nickey

[57] ABSTRACT

A retortable plastic container has a bottom wall having resting surface which surrounds a primary recessed portion. The primary recessed portion surrounds a secondary recessed portion. When the bottom wall of the container is viewed head-on the primary recessed portion has an outline which is circular, while the secondary recessed portion has an outline which is non-circular. The secondary recessed portion has major and minor axes which are mutually perpendicular and intersect one another on a longitudinal axis of the container. The distance across the secondary recessed portion along the major axis divided by the distance across the secondary recessed portion along the minor axis is greater than 1 but not greater than 3.

9 Claims, 16 Drawing Sheets

RETORTABLE PLASTIC CONTAINERS

TECHNICAL FIELD

The present invention relates generally to plastic containers, and more particularly to retortable plastic containers having a bottom configuration which reduces problems heretofore associated with the sterilization of plastic containers containing liquids.

BACKGROUND OF THE INVENTION

Many products which require sterilization, such as nutritionals and pharmaceuticals, have traditionally been packaged in glass containers. The technology associated with the sterilization of glass containers is very well developed. Glass bottles are most frequently sterilized under conditions in which there is a net vacuum inside the container so as not to subject the glass to tension during sterilization.

However, consumers have increasingly indicated a preference for plastic containers, due to factors such as lower cost, lower potential for container breakage with dangerous sharp debris, lower weight, and ecological concerns. In some instances a very hot liquid is placed into a plastic container during a "hot filling" operation and the plastic container is not subjected to retort conditions. However; for some products the plastic containers are filled, with a relatively cool liquid and then subjected to retort conditions to sterilize the contents. The sterilization of plastic containers has required careful control of sterilizer pressure in order to minimize excessive container deformation and the resulting catastrophic failure of such containers. In addition, the rate of change of sterilizer temperature has tended to be constrained by the need to minimize container-to-container temperature variations and thus the simultaneous need for different pressures for different containers within the sterilizer. Also, the maximum allowable container temperature has been limited due to a tendency of the plastic containers to become weaker at higher temperatures and a need for excessive pressures to prevent container deformation.

Typically, when containers are filled, steam is injected into the container just prior to the container being sealed. During sterilization, problems can arise with the deformation of a sealed container due in part to the inter-relatedness of product volume, headspace gas volume, and container volume. In a container packed without the use of a vacuum, the volume of product and the volume of the headspace gas equal the volume of the container. In a container packed under a vacuum, the volume of product plus the volume of the headspace gas is less than the volume of the sealed container, and the total fill equals the headspace volume plus the product volume.

The sterilization of plastic containers presents the possibility of encountering a problem herein referred to as catastrophic failure. Containers which experience catastrophic failure exhibit post-sterilization shapes which do not approximate the containers' pre-sterilization shape. If a failure occurs in the bottom of a container due to inadequate sterilizer pressure, the failure is called a buckled bottom or end. If a failure occurs in a sidewall of a container due to either inadequate or excessive sterilizer pressure, the failure is called a panel failure. Closure failure and failure of other container features are also common.

One proposed solution to the long felt need for a retortable plastic container is disclosed in U.S. Pat. No. 4,125,632. This patent proffers as the solution to the problem of catastrophic failure the presence of localized thin spots in the bottom wall of a container to facilitate expansion and contraction of the container's bottom during sterilization. This patent discloses that it is critical that the thickness of the sidewall must be thicker than the thickness of the base. Unfortunately, due to the criticality of the varying wall thickness the plastic container disclosed in U.S. Pat. No. 4,125,632, the can taught therein can only be made using certain manufacturing methods. For example, the container disclosed in the patent can not be made by extrusion blow molding.

Commonly owned U.S. patent application Ser. No. 817,001 filed on Jan. 3, 1992 discloses a retortable plastic container having a low panel strength and a bottom profile described by a particular equation. If a designer or engineer should choose to provide a container with features that result in a high panel strength such as using stronger plastics, using thick sidewalls or employing strengthening features such as ribs, catastrophic failures may still be frequently experienced. The teachings of this co-pending patent application still leave unsolved the problem of catastrophic failure during sterilization of a plastic container having a high panel strength.

As used herein and in the claims "panelling" is understood to mean a localized deformation in the sidewall of a container. As used herein and in the claims "panel strength" is understood to mean the net external pressure (difference between external and internal pressure) at which the sidewall of an empty sealed container buckles at a temperature of 21.3° C. (70° F.). As used herein and in the claims a "high panel strength" is understood to mean a panel strength of equal to or less than 17.5 kPa (2.54 p.s.i.). As used herein and in the claims a "low panel strength" is understood to mean a panel strength of equal to or less than 18.5 kPa (2.54 p.s.i.).

A critical performance requirement in retortable plastic containers with high panel strength is the capability of a container to deform in such a manner as to increase the volume of the container with increasing temperature and internal pressure, and decrease the volume of the container with decreasing temperature and internal pressure without experiencing a catastrophic failure. One benefit of a container possessing this capability is that with an increasing range of attainable container volumes during sterilization, the variation of the internal pressure in a container experienced during a given sterilization process is reduced. However, this capability also minimizes both the magnitude and range of internal pressures in containers during sterilization. The capabilities of a container to increase and decrease in volume reduces the possibility that either inadequate or excessive sterilizer pressure will cause a container to sustain a catastrophic container failure. Another benefit is that this capability also provides markedly larger allowable ranges of operating parameters which are ancillary to the sterilization process such as product fill, headspace gas volume, sterilizer pressure, product temperature, etc.

Containers which have the capability to expand a significant amount during sterilization and return substantially to their pre-sterilization shape without experiencing a catastrophic failure are easier to sterilize because such containers can survive diverse temperature-pressure conditions, thus allowing the use of rapid heating and cooling batch and continuous sterilizers, dependent on container fill conditions. Preferably a container must be able to deform to provide a container volume increase of at least about 6%, corresponding to the thermal expansion of the liquid packaged in the container, dependent on headspace gas volume, and preferably in excess of 10% without experiencing catastrophic failure of the container. This capability is especially advantageous when sterilizing heat sensitive nutritional and pharmaceutical products in which minimizing the thermal degradation of either product nutrition or medical potency is essential. Another coincident benefit is significantly reduced manufacturing costs due to higher sterilizer productivity. In a high panel strength container the majority of the expansion needs to occur in the bottom wall of the container, and a container in accordance with the invention disclosed herein has a recessed center portion which allows the required volume changes without panelling of the container.

A container structure which has utility for high panel strength retortable plastic containers is disclosed in co-pending U.S. patent application Ser. No. 702,558 filed May 20, 1991. It has been observed, however, that for both high and low panel strength retortable plastic containers the method of molding the container places limitations upon the dimensions and shape of the portion of the bottom of the container which is intended to compensate for changes in the volume of the container's contents during retort. The present invention provides high and low panel strength plastic containers which may be manufactured using a two piece mold which as used herein and in the claims is understood to be a mold which has two mating mold halves which contact one another along a plane which contains the longitudinal axis of the container. This plane along which the mold halves meet is referred to herein and in the claims as the "parting line" of the mold. The containers of the present invention are capable of the above described volume changes and may be manufactured using a two piece mold. The degree of volume change of which a plastic container of the present invention is capable cannot be attained with the structure taught in copending U.S. application 702,558 filed on May 20, 1991 without resorting to the use of at least a three piece mold in the manufacturing process. A three piece mold is one in which the bottom wall of the container is formed by one piece of the mold and the remainder of the container is formed by the other pieces of the mold. Therefore, the present invention facilitates a more economical method of manufacturing containers requiring fairly large volumetric changes during a retort procedure.

BRIEF DESCRIPTION OF THE DRAWINGS

The features of the present invention which are believed to be novel are set forth with particularity in the appended claims. The present invention, both as to its structure and manner of operation, may best be understood by referring to the following detailed description, taken in accordance with the accompanying drawings in which:

DETAILED DESCRIPTION OF THE INVENTION

As used herein and in the claims "container" is understood to mean a container by itself without a closure.

As used herein and in the claims "panelling" is understood to mean a localized deformation in the sidewall of a container. As used herein and in the claims "panel strength" is understood to mean the net external pressure (difference between external and internal pressure) at which the sidewall of an empty sealed container buckles at a temperature of 21.3° C. As used herein and in the claims "panel strength" is understood to mean a panel strength of greater than 17.5 kPa (2.54 p.s.i.) and "low panel strength" is understood to mean a panel strength of up to and including 2.54 p.s.i.

As used herein and in the claims "plastic" is understood to have the meaning stated in ASTM D883-5T, to wit: a material that contains as an essential ingredient an organic substance of large molecular weight, is solid in its finished state, and, at some stage in its manufacture, or in its processing into finished articles can be shaped by flow.

Figure 3:
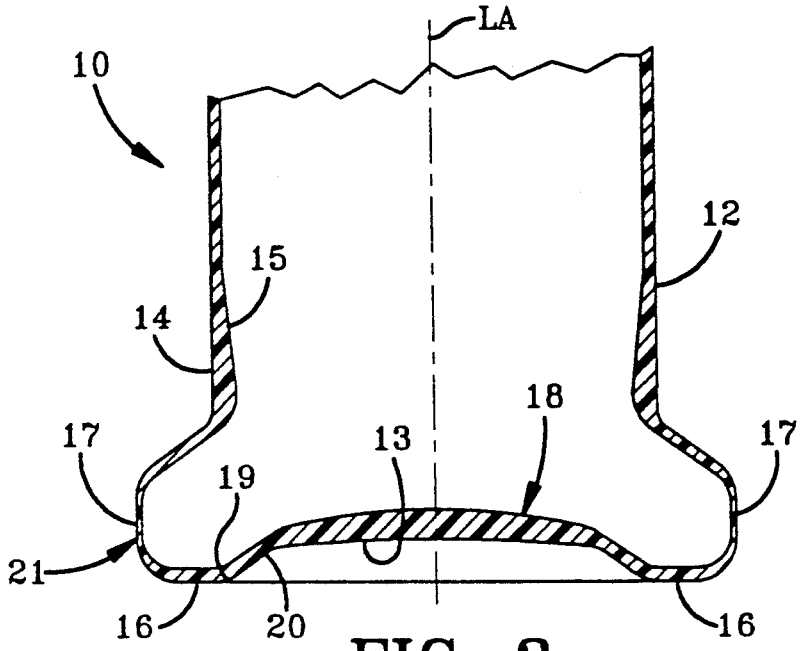
FIG-3 PRIOR ART
FIGS. 1–3 present a prior art plastic container.
Figure 1:
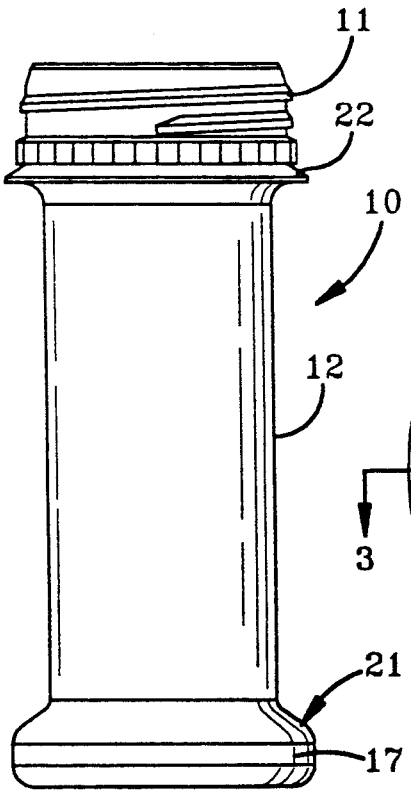
FIG-1 PRIOR ART
Figure 2:
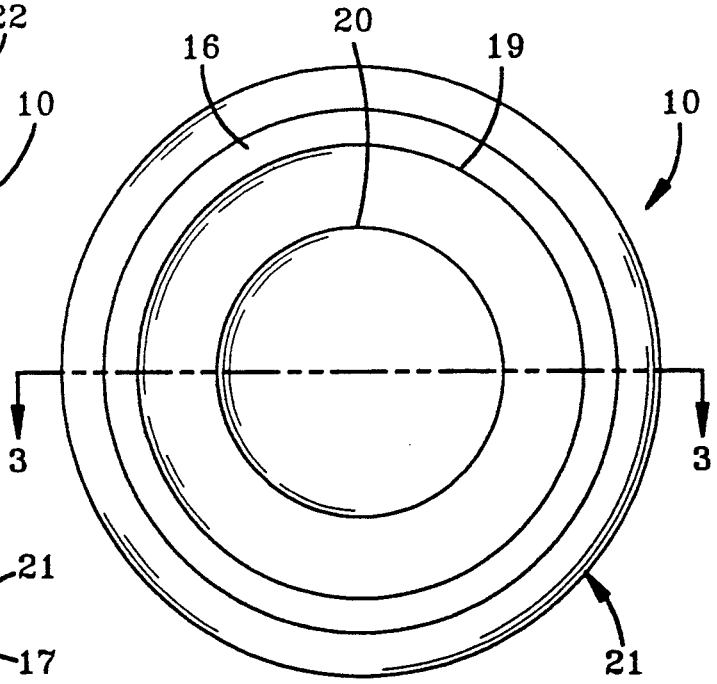
FIG-2 PRIOR ART

Referring first to FIGS. 1–3 there is shown a prior art plastic container 10 which is taught in U.S. Pat. No. 5,217,737. As used herein and in the claims terms such as "upper", "lower", "top", "bottom" and other words describing relative vertical locations are understood to refer to a container that is sitting on a flat and level surface such that the longitudinal axis 11 of the container is oriented perpendicular to the flat surface.

As used herein and in the claims "vertical" is understood to mean a direction which is both parallel to the longitudinal axis LA of a container and perpendicular to a flat and level surface upon which the container is resting, and "horizontal" is understood to mean a direction which is both perpendicular to the longitudinal axis of a container and parallel to a flat and level surface upon which a container is resting.

As used herein and in the claims "radial" and "radially" are understood to mean directions which are perpendicular to the longitudinal axis of the container, with "radially inward or inwardly" being a direction going towards the longitudinal axis and "radially outward or outwardly" being a direction going away from the longitudinal axis.

The base portion of the prior art container 10 includes a sidewall 12 which forms a generally cylindrical main body portion and a bottom wall 13 which are formed as a single piece. A neck portion 11 having an opening therethrough is disposed at one end of the main body portion with a flange 22 interposed between the neck portion and the main body portion. A suitable closure (not shown) may be threadably attached to the neck portion after the desired contents are placed in the container. A base portion 21 is disposed at an opposite end of the main body portion from the neck portion. The container has an exterior surface 14 and an interior surface 15. At the lowermost portion of the exterior surface of the bottom wall of the container is a resting surface 16. A heel portion 17 of the base portion 21 of the container 10, which extends circumferentially about a recessed circular center portion 18 of the bottom of the container which has as its center the longitudinal axis LA of the container. Associated with the curvature of the exterior surface of the bottom of the container are (a) an outside corner 19 which connects the resting surface with the recessed center portion, and (b) an inside corner 20 which is disposed within the recessed center portion. As used herein and in the claims a corner is an "outside corner" if the swing point associated therewith is located interior of the container and is an "inside corner" if the swing point associated therewith is located exterior of the container. The primary feature of the structure of the bottom wall of this prior art container which is to be noted is that both the outside corner 19 and inside corner 20 which define the recessed portion 13 of the bottom wall of the container appear as circles when the bottom of the container is viewed head-on as shown in FIG. 3.

As taught in commonly owned copending U.S. patent application Ser. No. 702,558 filed on May 20, 1991 a cross-sectional profile of the exterior surface of the recessed circular center portion of the bottom wall of this prior art container taken in a vertical plane which contains the longitudinal axis of the container is described by the following equation:

$$\begin{aligned} VMAX = {} & CINT + CA*NA + CB*N + CC*NC + \\ & CD*ND + CE*NE + CF*N + CAB*NA*NB + \\ & CAC*NA*NC + CAF*NA*N + CBC*NB*NC + \\ & CBD*NB*ND + CBF*NB*N + CCD*NC*ND + \\ & CCF*NC*N + CDE*ND*NE + CDF*ND*N + \\ & CEF*NE*N + CA2*NA*NA + CC2*NC*NC + \\ & CD2*ND*ND + CF2*N*N \end{aligned}$$

where $VMAX \geqq 0.9736 + 0.10795*F - 0.014365*F*F$, with VMAX being the factor by which the volume of the container is increased when the container contains a liquid and is sealed with a closure and is subjected to a peak sterilization temperature in the range of 250° F. to 266° F.; and $$\begin{aligned} CINT = {} & 0.95141;\ CA = 0.431643;\ CB = 0.0233244; \\ & CC = 0.444403;\ CD = -0.48394;\ CE = -0.067243; \\ & CF = 0.162753;\ CAB = -0.17774;\ CAC = -0.88224; \\ & CAF = -0.031124;\ CBC = -0.24037; \\ & CBD = 0.246981;\ CBF = 0.0172123;\ CCD = 0.372528; \\ & CCF = -0.034754;\ CDE = 0.392639; \\ & CDF = -0.043493;\ CEF = 0.124634; \\ & CA2 = -0.25598;\ CC2 = -0.39205; \\ & CD2 = 0.298769;\ CF2 = -0.043109;\ \text{and} \\ & N = F/1.711;\ NA = A/N;\ NB = B/N;\ NC = C/N; \\ & ND = D/N;\ \text{and}\ NE = E/N;\ \text{with} \end{aligned}$$

A being in the range of 0.044 inch to 2.000 inches and being the weighted average of the radii of (a) a first circle which is a cross-section of a first toroid which is associated with the curvature of the exterior surface of the bottom of the container at an outside corner which connects the resting surface with said recessed circular center portion and (b) the radius of a second circle which is a cross-section of a second toroid which is associated with the curvature of the exterior surface of an inside corner which is disposed within said recessed circular center portion; wherein the weighted average of the radii is the quotient of (a) the angular value of an arc of the first circle which is in contact with the exterior surface of the bottom wall of the container times the radius of the first circle, plus the angular value of an arc of the second circle which is in contact with the exterior surface of the bottom wall of the container times the radius of the second circle, divided by (b) the sum of the angular values of the two arcs; the thickness of the bottom wall of the container beginning at about the center of said second circle to the radially outer edge of the recessed circular portion becomes progressively thinner as the radial distance from the longitudinal axis of the container becomes greater;

B being in the range of 0.400 inch to 4.000 inches and being the minimum horizontal distance between two circles which are disposed on opposite sides of the longitudinal axis of the container and are both cross sections of said first toroid;

C being in the range of −1.359 to 0.954 inch and being the horizontal distance between (a) a first vertical line which is tangent to a first circle which is a cross-section of said first toroid and (b) a second vertical line which is tangent to a second circle which is a cross-section of said second toroid with both of said circles being located on the same side of the longitudinal axis of the container and both of said vertical lines being interposed between said circles;

D being in the range of 0.022 inch to 1.062 and being the vertical distance between (a) a horizontal line which is tangent to said resting surface and (b) the exterior surface of the bottom of said container at the longitudinal axis of said container;

E being in the range of 0.400 inch to 1.001 inches and being the vertical distance between (a) a horizontal line which is tangent to said resting surface and (b) a horizontal line which is tangent to the top of a circle which is a cross-section of said second toroid; and, F being in the range of 0.563 inch to 4.000 inches and being the horizontal distance between (a) the radially outer edge of the recessed circular center portion on one side of the longitudinal axis and (b) the radially outer edge of the recessed circular portion on the opposite side of the longitudinal axis.

The manufacture of a plastic container having such a bottom profile may require the use of a three piece mold in order to facilitate adequate volume change of the container during retort without an unacceptably high risk of catastrophic failure. However, as will be disclosed herein, a new bottom profile which will alleviate these problems in a container having the general overall configuration shown in FIGS. 1-3 may be provided in accordance with the present invention.

As taught in commonly owned copending U.S. patent application Ser. No. 702,558 filed on May 20, 1991, a preferred embodiment of a prior art plastic container having the configuration shown in FIGS. 1-3 has an overall height of about 4.2 inches (106.7 mm), a maximum outside diameter of about 1.76 inches (44.7 mm) in the base portion, an outside diameter of about 1.32 inches (33.53 mm) in the main body portion, and is intended to contain about two fluid ounces (59.14 $cm^3$) of a liquid product. A plastic container having these same dimensions, but having a bottom wall according to the invention which is disclosed herein, is a preferred embodiment of the present invention.

It has been determined that a container according to both the prior art and the present invention which is intended to contain a non-oxygen sensitive liquid product such as sterile water may be satisfactorily manufactured entirely of an ethylene-propylene random copolymer (available from EXXON as PP-9122) using an injection stretch blow molding method. The predetermined peak sterilization temperature for these containers is in the range of 122.1° C. to 131° C., with a target for sterilization pressure in the range of saturated steam pressure to saturated steam +12 p.s.i. air pressure. In the preferred prior art embodiment the side wall of the container has a thickness in the range of about 0.02 inch to 0.05 inch and the bottom wall has a thickness in the range of about 0.04 inch to 0.10 inch.

It has been determined that a container according to the both the prior art and the present invention intended to contain an oxygen sensitive product such as a milk-based nutritional product for human infants preferably manufactured with plurality of layers of plastics. The plastic which forms the interior surface of the container should be a material which is chemically insert with respect to the contents of the container, and one of the layers of plastic should be a material that is substantially impermeable to air. A satisfactory multilayer container has been manufactured having the structure set forth in TABLE I, with layer 1 being the layer which forms the interior surface of the container and each successively numbered layer progressing towards the exterior of the container. An interesting feature of this multilayer structure is the composition of layer 2 from a mixture of virgin materials plus recycled materials which were flashing or unsatisfactory containers, with the recycling being done regularly as part of the container manufacturing process. Layer 4 is the gas barrier layer and layers 3 and 5 are adhesive layers.

TABLE I

| LAYER | MATERIAL | PERCENT OF WALL THICKNESS | SUPPLIER |
|---|---|---|---|
| 1 | ethylene-propylene random copolymer | 14 | EXXON, PP-9122 |
| 2 | mixture of all components of the multilayer wall | 65 | CONTAINER MANUFACTURER |
| 3 | maleic anhydride-polypropylene graft copolymer | 1.5 | MITSUI, Admer QF-500 |
| 4 | ethylene vinyl alcohol copolymer | 4 | EVALCA, either EVAL SC F-101A or EVAL LC F-101A |
| 5 | maleic anhydride-propylene graft copolymer | 1.5 | MITSUI, Admer QF-500 |
| 6 | ethylene-propylene random copolymer | 14 | EXXON, PP-9122 |

Figure 6:
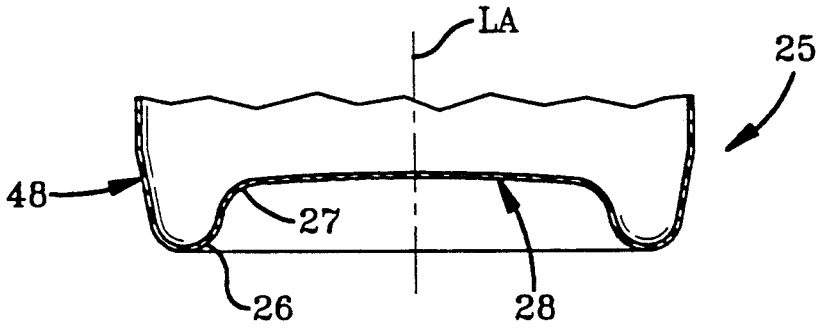
FIG-6 PRIOR ART
FIGS. 4–6 present a second prior art plastic container.
Figure 4:
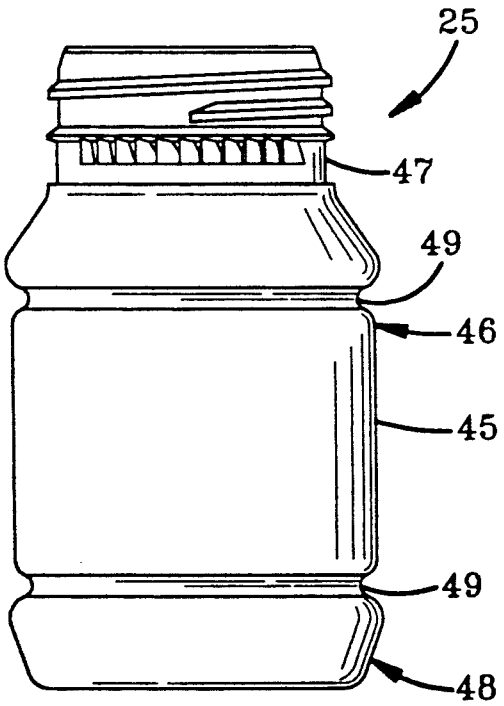
FIG-4 PRIOR ART
Figure 5:
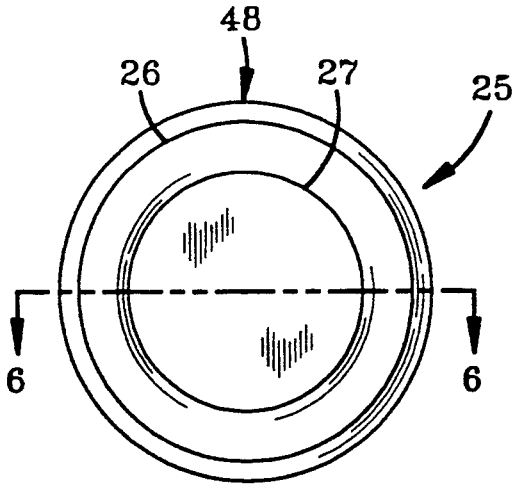
FIG-5 PRIOR ART

Referring next to FIGS. 4–6 there is shown another prior art plastic container which also is taught in commonly owned copending U.S. patent application Ser. No. 702,558 filed on May 20, 1991. As in the prior art embodiment of FIGS. 1–3 both the outside corner 26 and inside corner 27 which define the recessed portion 28 of the bottom wall of the container appear as circles when the bottom of this container is viewed head-on as shown in FIG. 5. The container has a sidewall 45 which forms a generally cylindrical main body portion 46. A neck portion 47 having an opening therethrough is disposed at one end of the main body portion, and a base portion 48 is disposed at the other end of the main body portion. A suitable closure (not shown) may be attached to the neck portion 47 by means for attachment such as threads or adhesives or welding after the desired contents are placed in the container. The main body portion has grooves 49 therein which extend circumferentially around the main body portion and function to rigidify the main body portion and increase the panel strength of the container. The profile of the bottom wall of this prior art container is taught in the copending application described above in the description of FIGS. 1–3. The materials described as suitable for containers of the prior art and the present invention are the same as described above with respect to FIGS. 1–3.

Figure 8:
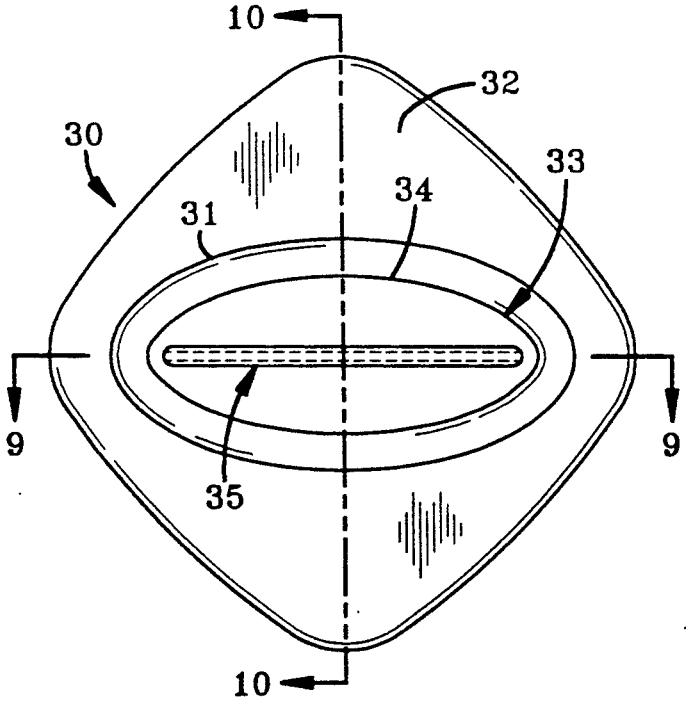
FIG-8 PRIOR ART

Prior art plastic containers having the configuration illustrated in FIGS. 4–6 have been manufactured with an overall height of about 3.37 inches (85.6 mm), a maximum outside diameter of about 2.05 inches (52.07 mm), and are sized to contain about four fluid ounces (118.3 $cm^3$) of a liquid product. Plastic containers having the bottom wall configuration of the present invention which is disclosed herein may be manufactured with the general configuration and dimension taught in these prior art containers. Referring next to FIGS. 7–10 there is shown a prior art plastic container 30 having a main body portion 36 of a generally rectangular shape which has been used commercially by Mead Johnson Nutritionals, a Bristol-Myers Squibb Co., of Evansville, Ind. U.S.A. as a container for a liquid product sold under the trade name Ricelyte TM. The main body portion 36 has grooves 37 therein which extend completely about the main body portion and function to rigidify the main body portion and increase the panel strength of the container. A base portion 38 is located at the bottom of the main body portion, and a neck portion 39 having an opening therethrough is located at the top of the main body portion. A suitable closure (not shown) may be attached to the neck portion by means for attachment such as threads or adhesives or welding after the desired contents are placed in the container. In this prior art plastic container the outside corner 31 which connects the resting surface 32 of the bottom wall of the container to a recessed portion 33 appears as an ellipse when the bottom of the container is viewed head-on as shown in FIG. 8. Furthermore, the inside corner 34 also appears as an ellipse when the bottom wall of the container is viewed head-on as shown in FIG. 8. Note that the recessed portion of the bottom wall of this container has a rail 35 molded integral therewith to facilitate hanging the container upside if desired. It is understood that a container having this same general shape and configuration, and formed of the materials described above with respect to FIGS. 1–3, may employ the bottom wall configuration of the present invention which will be disclosed herein.

Figure 9:
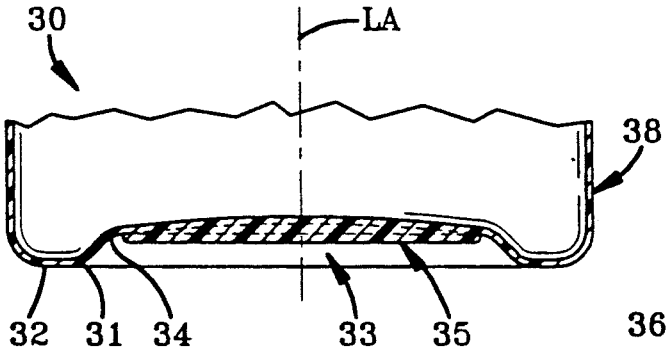
FIG-9 PRIOR ART
FIGS. 7–10 present a third prior art plastic container.
Figure 7:
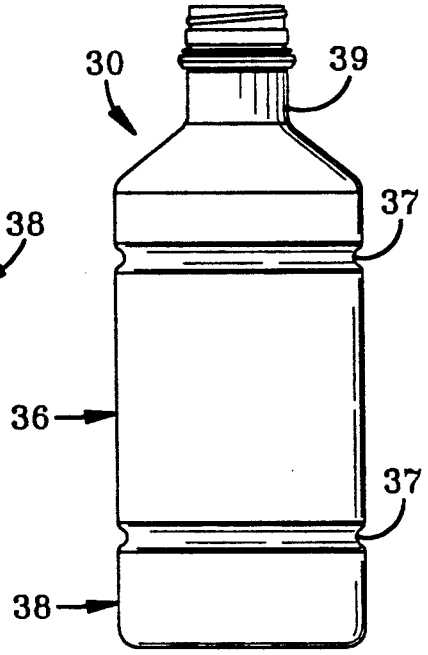
FIG-7 PRIOR ART
Figure 10:
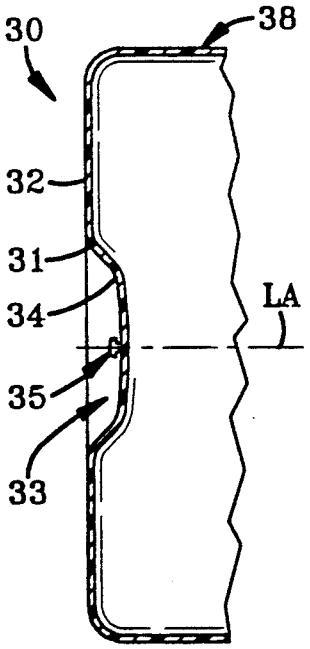
FIG-10 PRIOR ART
Figure 12:
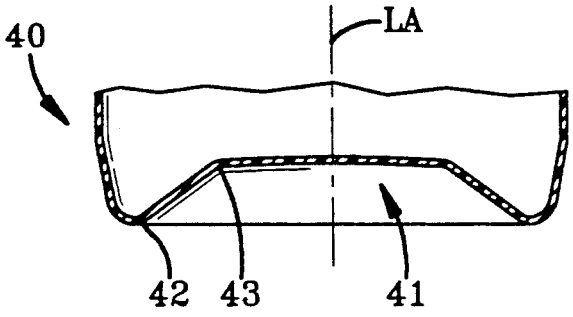
FIGS. 11–13 present an experimental plastic container.
Figure 11:
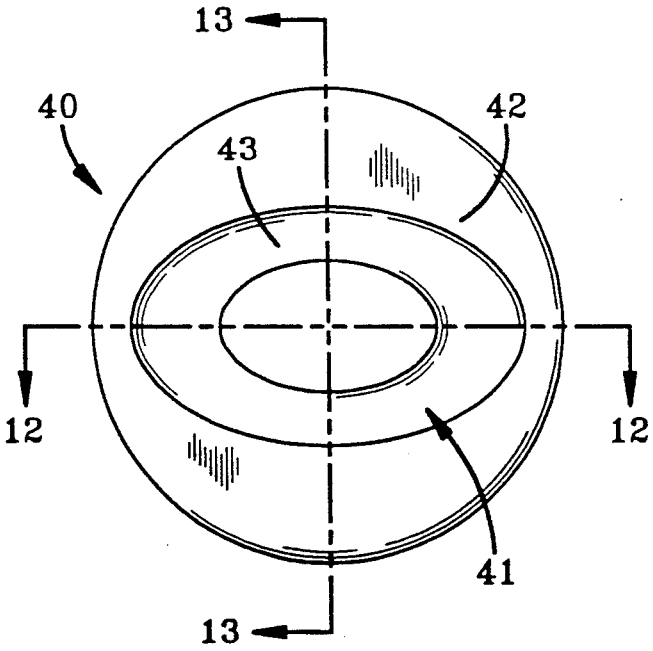
Figure 13:
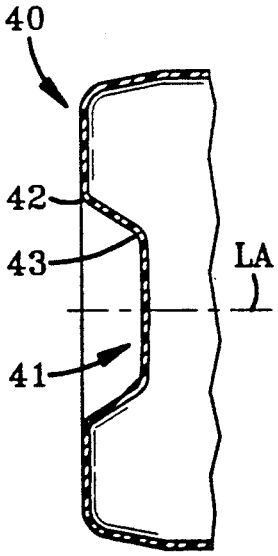

Referring next to FIGS. 11–13 there is shown the base portion of a circular plastic container 40 of the general size, shape and configuration of the prior art container of FIGS. 4–6, distinguished by having a recessed portion 41 of its bottom wall shaped similar to the recessed portion in the prior art Mead Johnson plastic container of FIGS. 7–10. That is to say, both the outside corner 42 and inside corner 43 which define the recessed portion 41 in the bottom wall of the circular plastic container appear as ellipses when the bottom wall is viewed head-on as shown in FIG. 11.

Figure 15:
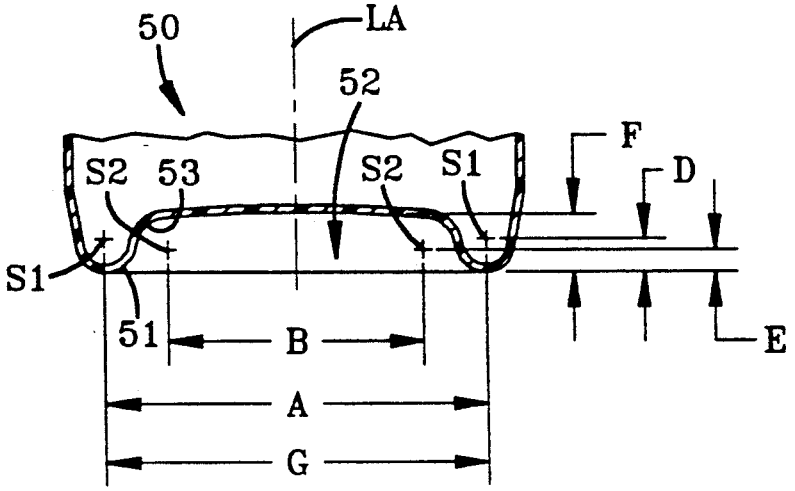
FIGS. 14–16 present a plastic container according to the present invention.
Figure 14:
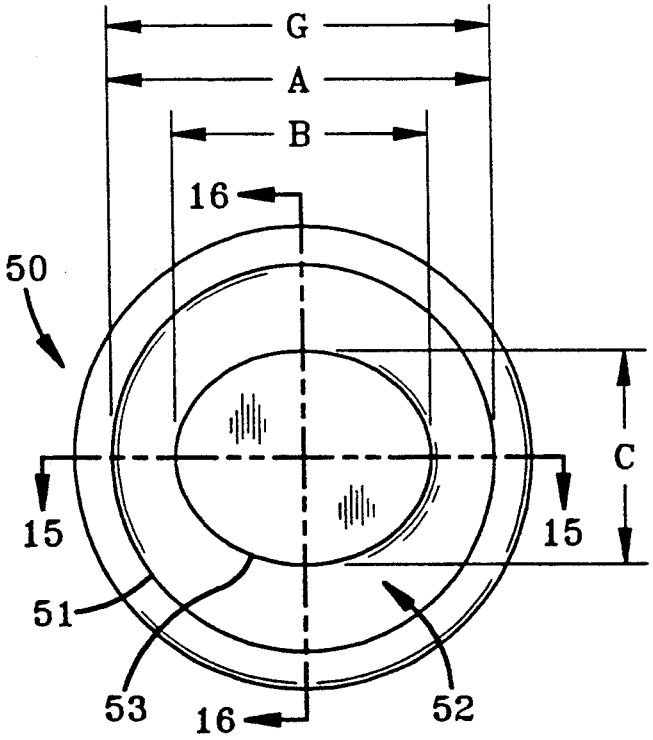
Figure 16:
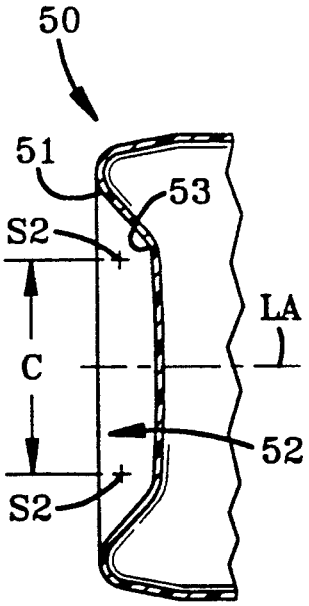

Referring next to FIGS. 14–16 there is shown the base portion of a plastic container 50 in accordance with the present invention. This particular plastic container is of the general size, shape and configuration of the prior art container of FIGS. 4–6 distinguished by the outside corner 51 which defines a primary recessed portion 52 in the bottom wall of the container appearing as a circle when the bottom of the container is viewed head-on as shown in FIG. 14, while the inside corner 53 which defines a secondary recessed portion in the bottom wall of the container appears as an ellipse when the bottom of the container is viewed head-on as shown in FIG. 14. That is to say, the primary recessed portion surrounds the secondary recessed portion, and is disposed intermediate of the resting surface and the secondary portion. A plastic container in accordance with the present invention has a bottom wall with the following characteristics, with reference to FIGS. 14–16:

A is the horizontal distance measured along a line which intersects the longitudinal axis LA between the centerpoints S1 of circle (not shown) on one side of the longitudinal axis and S1 on the other side of the longitudinal axis. Put another way, in a cross-sectional profile of the exterior surface of the primary recessed portion of the bottom wall of a container taken in a vertical plane which contains the longitudinal axis of the container, A is the horizontal distance between (a) the center point S1 of a first circle (not shown) on one side of the longitudinal axis and (b) the center point S1 of a second circle (not shown) on the opposite side of the longitudinal axis, with both of the circles being cross-sections of a toroid which is associated with the curvature of the exterior surface of the bottom wall of the container at an outside corner which connects the resting surface with the recessed center portion.

As used herein and in the claims the "major axis" of the non-circular secondary recessed portion of the bottom wall of a plastic container is a line located in a plane which contains the longitudinal axis of the container and the greatest horizontal dimension of the non-circular region. In a preferred embodiment of a plastic container of the present invention this "major axis" is coincident with the parting line of a two-piece mold used in the manufacture of the container. As used herein and in the claims the "minor axis" of the non-circular secondary recessed portion of the bottom wall of a container is a line which is perpendicular to the major axis and intersects the longitudinal axis of the plastic container. As used herein and in the claims the "resting surface" of the bottom wall of a container is that surface which contacts a flat surface when the container is setting upright on the flat surface.

B is the horizontal distance measured along the major axis of the non-circular secondary recessed portion of the bottom wall of the container. This major axis intersects the longitudinal axis LA of the container and extends between the centerpoint S2 of a circle (not shown) on the other side of the longitudinal axis. Put another way, in a cross-sectional profile of the exterior surface of the recessed portion of the bottom wall of a container taken in a vertical plane which contains the longitudinal axis of the container, B is the horizontal distance between (a) the center point S2 of a first circle (not shown) on one side of the longitudinal axis and (b) the center point S2 of a second circle (not shown) on the opposite side of the longitudinal axis, with both of the circles being cross-sections of a toroid-like shape which is associated with the curvature of the exterior surface of an inside corner which is disposed within the recessed portion of the bottom wall.

C is the horizontal distance measured along the minor axis of the non-circular secondary recessed portion of the bottom wall of the container. This minor axis intersects the longitudinal axis of the container and extends between the centerpoint S2 of a circle (not shown) on one side of the longitudinal axis (LA) and a centerpoint S2 of a circle (not shown) on the other side of the longitudinal axis. Put another way, in a cross-sectional profile of the exterior surface of the recessed portion of the bottom wall of a container taken in a vertical plane which contains the longitudinal axis of the container and the minor axis of the non-circular secondary recessed portion of the bottom wall of the container C is the horizontal distance between (a) the center point S2 of a first circle (not shown) on one side of the longitudinal axis and (b) the center point S2 of a second circle (not shown) on the opposite side of the longitudinal axis, with both of the circles being cross-sections of a toroid-like shape which is associated with the curvature of the exterior surface of an outside corner which is disposed within the recessed portion of the bottom wall.

As used herein and in the claims, the "aspect ratio" of the non-circular secondary recessed portion of the bottom wall of a plastic container is the ratio of the extent B of the secondary recessed portion taken along the major axis to the extent C of the secondary recessed portion taken along the minor axis. The aspect ratio (B/C) of the secondary recessed portion of the bottom wall of a container according to the present invention is greater than 1 but less than 3.

D is the vertical distance from the resting surface of the container bottom to the centerpoint S1 of a circle (not shown) associated with the curvature of the outer surface of the outside corner of the heel. Put another way, in a cross-sectional profile of the recessed portion of the bottom wall of a container taken in a vertical plane which contains the longitudinal axis of the container, D is the vertical distance between (a) a line which is tangent to the resting surface of the container and (b) the center point S1 of a circle (not shown) which is a cross-section of a toroid which is associated with the curvature of the exterior surface of an outside corner which is disposed within the recessed center portion of the bottom wall.

E is the vertical distance from the resting surface of the container bottom to the centerpoint S2 of a circle (not shown) associated with the curvature of the outer surface of the outside corner of the heel. Put another way, in a cross-sectional profile of the recessed portion of the bottom wall of a container taken in a vertical plane which contains the longitudinal axis of the container, E is the vertical distance between (a) a line which is tangent to the resting surface of the container and (b) the center point S2 of a circle (not shown) which is a cross-section of a toroid which is associated with the curvature of the exterior surface of an outside corner which is disposed within the recessed portion of the bottom wall.

F is the vertical distance between (a) a horizontal line which is tangent to the resting surface of the container and (b) the exterior surface of the bottom wall of the container as measured along the longitudinal axis of said container. Put another way, in a cross-sectional profile of the exterior surface of the bottom wall of a container taken in a vertical plane which contains the longitudinal axis of the container, F is the vertical distance between (a) a horizontal line which is tangent to the resting surface of the container and (b) the exterior surface of the bottom of the container as measured along the longitudinal axis of said container.

G is the horizontal distance between the radially outer edge of the resting surface on opposite sides of the longitudinal axis of the container as measured on a line which intersects the longitudinal axis. Put another way, in a cross-sectional profile of the exterior surface of the bottom wall of a container taken in a vertical plane which contains the longitudinal axis of the container, G is the horizontal distance between (a) the radially outer edge of the resting surface of the bottom wall of the container on one side of the longitudinal axis and (b) the radially outer edge of the resting surface of the bottom wall of the container on the opposite side of the longitudinal axis.

As used herein, RS1 is the radius of a circle having as its center point, S1, with RS1 being the distance between the center point and the circle defining the outside corner of the exterior surface of the bottom wall of the container. Likewise, RS2 is the radius of a circle having as its center point S2, with RS2 being the distance between the center point and the circle defining the inside corner of the exterior surface of the bottom wall of the container.

Figure 18:
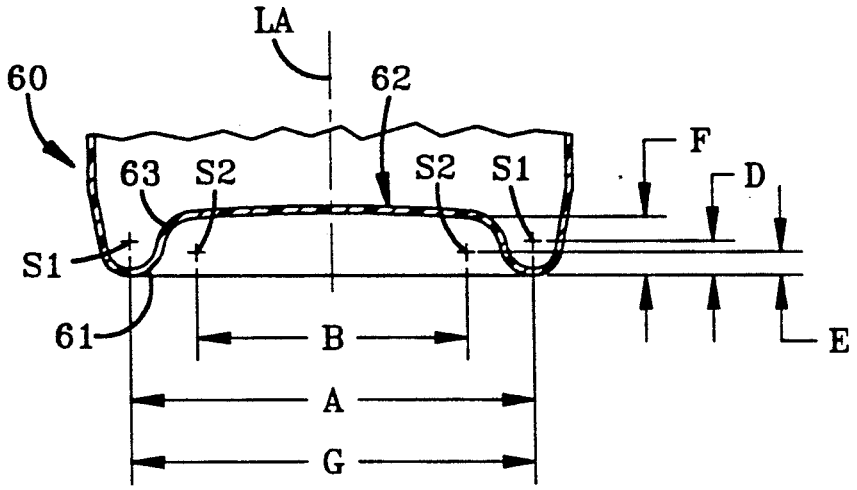
FIGS. 17–19 present an experimental plastic container.
Figure 17:
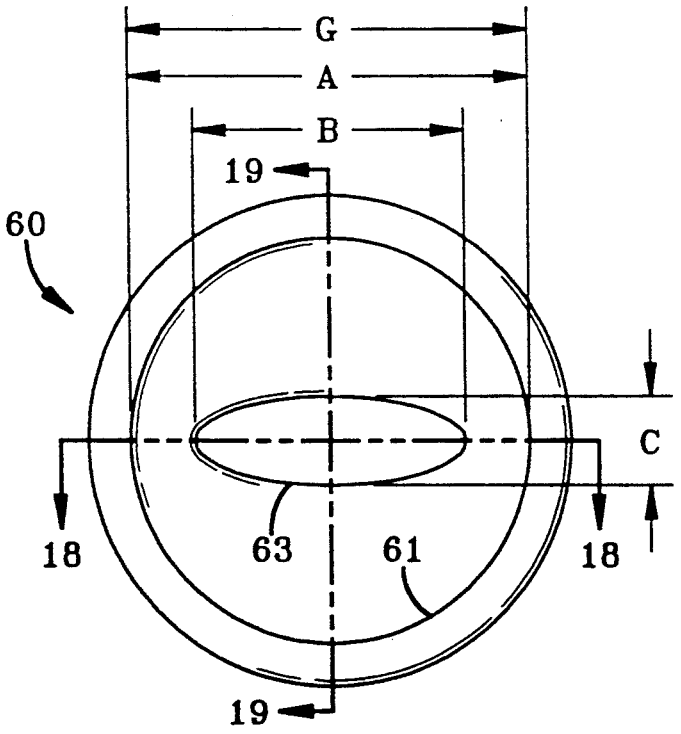
Figure 19:
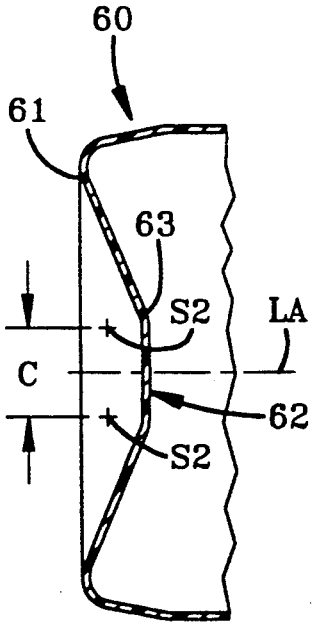

Referring next to FIGS. 17–19 there is shown the base portion of a circular plastic container 60 having the general size, shape and configuration of the prior art containers of FIGS. 4–6 distinguished by the outside corner 61 which defines the recessed portion 62 in the bottom wall of the container appearing as a circle when the bottom wall of the container is viewed head-on as shown in FIG. 17, while the same time the inside corner 63 appears as an ellipse when the bottom of the container is viewed head-on as shown in FIG. 17. However, in this container the aspect ratio (B/C) of the non-circular secondary recessed portion is greater than 3.

Figure 20A:
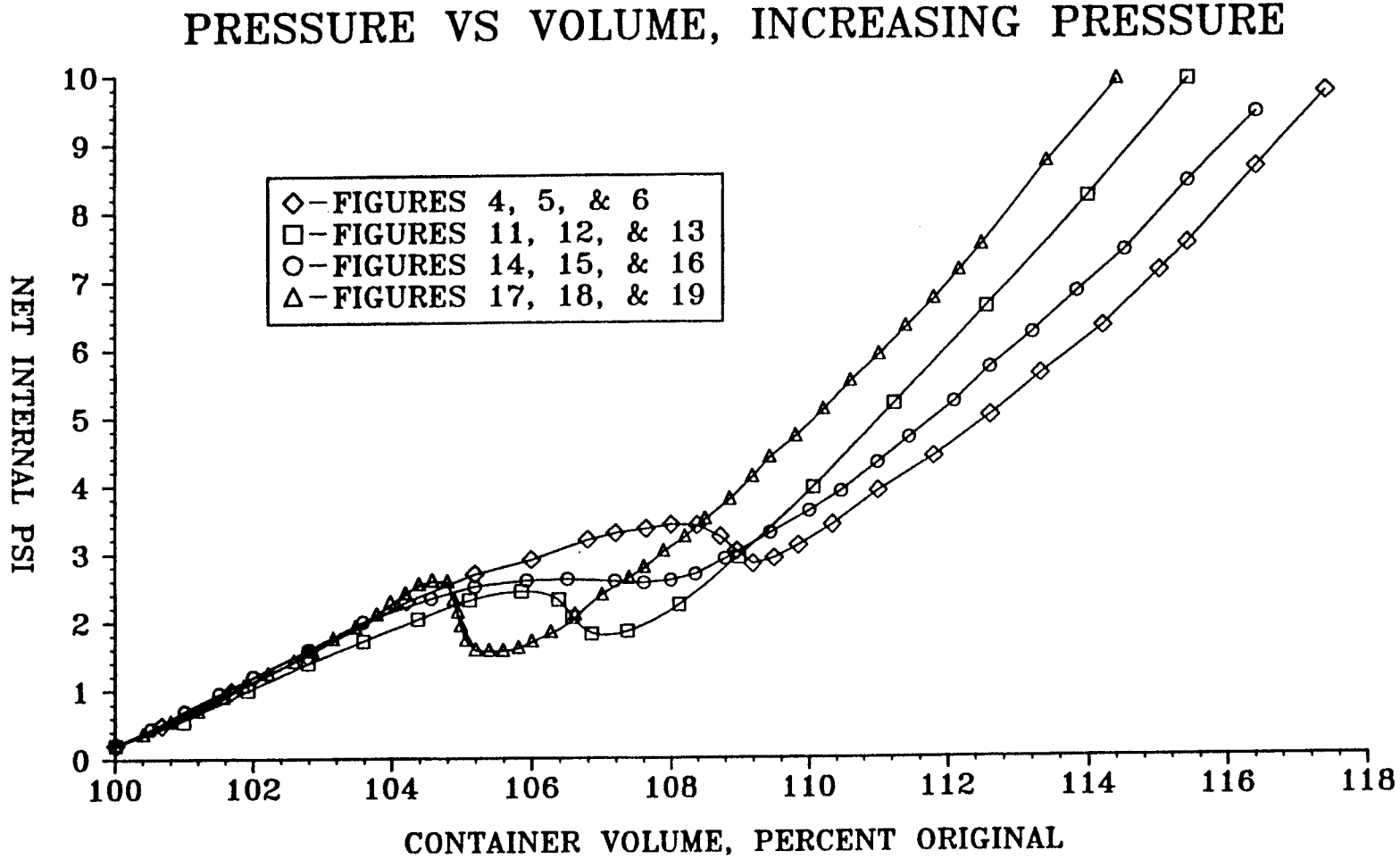
FIG. 20A is a graphic representation of internal pressure versus container volume for several different containers when the contents of the container are increasing in temperature.
Figure 20B:
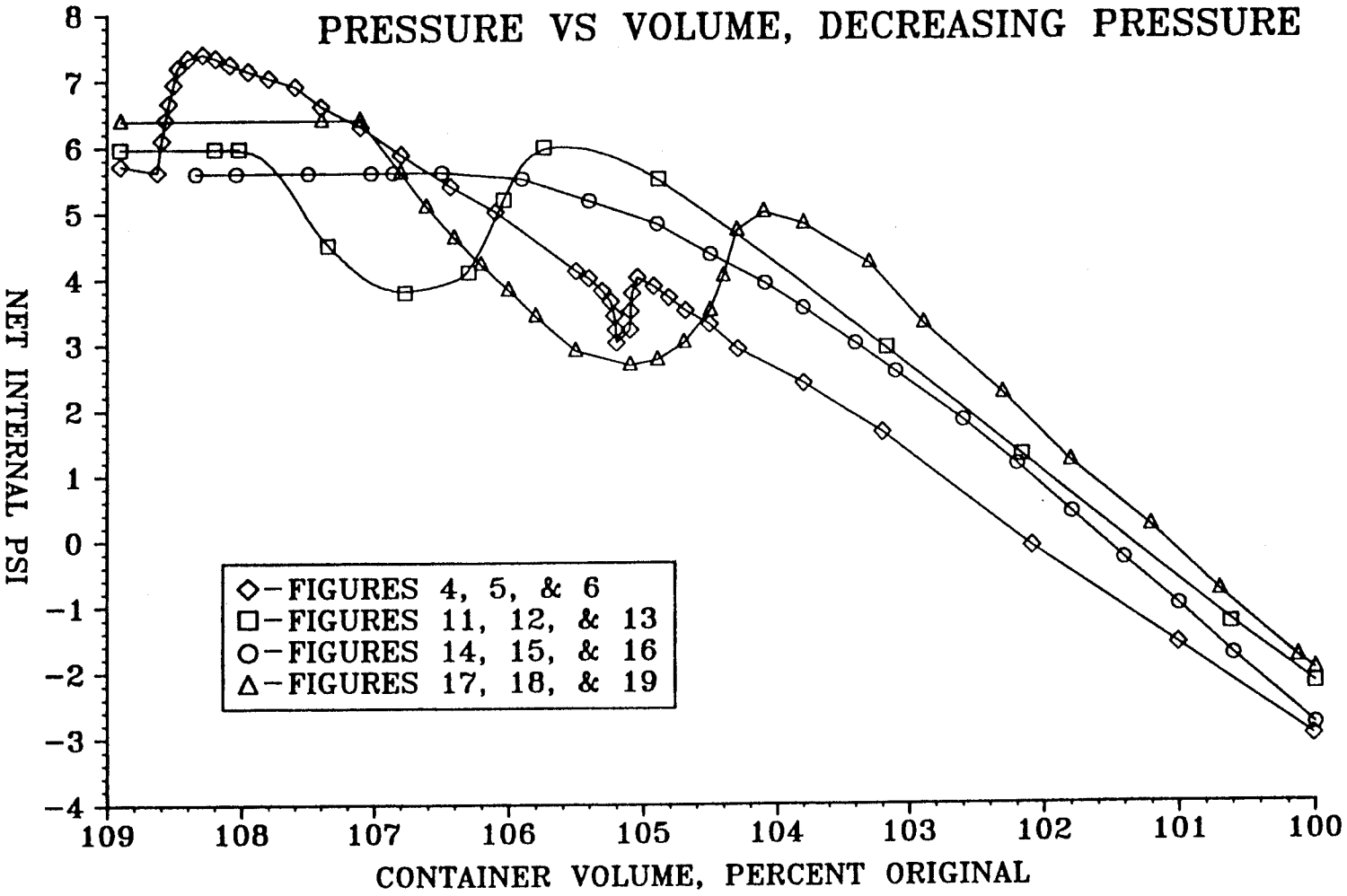
FIG. 20B is a graphic representation of internal pressure versus container volume for several different containers when the contents of the containers are decreasing in temperature.

FIGS. 20A and 20B are graphs showing net-internal pressure in a sealed container filled with a liquid (water) as a function of container volume. The plots were generated using a sophisticated computer modeling simulation program. The validity of this computer model has been confirmed in the past against actual laboratory data, but such a confirmation has been performed only for the prior art embodiment of FIGS. 4–6 and not the other containers presented in these graphs. FIG. 20A presents a situation where a filled and sealed container is going through portions of a retort process during which the contents of the container are increasing in temperature such that the container volume and internal pressure are increasing. FIG. 20B presents a situation where a filled and sealed container is going through the portion of a retort process during which the contents of the container are decreasing in temperature such that the container volume and internal pressure are decreasing. All of the simulated containers had the general size, shape and configuration of the prior art bottles shown and described with respect to FIGS. 4–6, but were distinguished by bottom walls of a variety of configurations.

It is important to understand the phenomena of "snap-through" of the bottom wall of a plastic container during a retort process. A retort process typically involves a heating cycle, a hold cycle where the retort temperature is held substantially constant to achieve commercial sterility of the product in the container, and a cooling cycle. During the heating and holding cycles the internal pressure and container volume are increasing, while during the cooling cycle the internal pressure and container volume are decreasing. Retortable plastic containers may be provided with a recessed portion in the bottom wall of the container which is intended to change in shape from concave to convex during the heating and hold cycles, and then return to concave during the cooling cycle. It is believed to be desirable to have these changes occur gradually, but when these changes occur suddenly the phenomena is referred to herein as "snap-through". One of the reasons that snap-through is not desirable is that if during the cooling cycle the exact conditions (internal pressure at a particular container volume) are not achieved due to what are normally commercially acceptable variations in sterilizer operation, the container will not return to substantially its pre-retort shape. Such a deformed container may not be capable of resting solidly on a flat surface, but rather will rock or even be incapable of sitting upright.

In order to evaluate the snap-through of the prior art container shown in FIGS. 4–6 a four ounce container having the exemplary dimensions set forth in the description of FIGS. 4–6 and a bottom profile taught in U.S. Pat. No. 5,217,737 was simulated. A cross-sectional profile of the exterior surface of the recessed circular center portion of the bottom wall of the container taken in a vertical plane which contains the longitudinal axis of the container being described as follows:

(i) the weighted average of the radii of (a) a first circle which is a cross-section of a first toroid which is associated with the curvature of the exterior surface of the bottom of the container at an outside corner which connects the resting surface with said recessed circular center portion and (b) the radius of a second circle which is a cross-section of a second toroid which is associated with the curvature of the exterior surface of an inside corner which is disposed within said recessed circular center portion; wherein the weighted average of the radii is the quotient of (a) the angular value of an arc of the first circle which is in contact with the exterior surface of the bottom wall of the container times the radius of the first circle, plus the angular value of an arc of the second circle which is in contact with the exterior surface of the bottom wall of the container times the radius of the second circle, divided by (b) the sum of the angular values of the two arcs; the thickness of the bottom wall of the container beginning at about the center of said second circle to the radially outer edge of the recessed circular portion becomes progressively thinner as the radial distance from the longitudinal axis of the container becomes greater is about 0.14 inches;

(ii) the minimum horizontal distance between two circles which are disposed on opposite sides of the longitudinal axis of the container and are both cross sections of said first toroid is about 1.42 inches;

(iii) the horizontal distance between (a) a first vertical line which is tangent to a first circle which is a cross-section of said first toroid and (b) a second vertical line which is tangent to a second circle which is a cross-section of said second toroid with both of said circles being located on the same side of the longitudinal axis of the container and both of said vertical lines being interposed between said circles is about −0.004 inches (the two circles overlap by this distance);

(iv) the vertical distance between (a) a horizontal line which is tangent to said resting surface and (b) the exterior surface of the bottom of said container at the longitudinal axis of said container is about 0.26 inch;

(v) the vertical distance between (a) a horizontal line which is tangent to said resting surface and (b) a horizontal line which is tangent to the top of a circle which is a cross-section of said second toroid is about 0.24 inch;

(vi) the horizontal distance between (a) the radially outer edge of the recessed circular center portion on one side of the longitudinal axis and (b) the radially outer edge of the recessed circular portion on the opposite side of the longitudinal axis is about 1.71 inches;

(vii) the horizontal distance between (a) the center point of a first circle on one side of the longitudinal axis and (b) the center point of a second circle on the opposite side of the longitudinal axis with both of the circles being cross-sections of said first toroid is about 1.71 inches;

(viii) the horizontal distance between (a) the center point of a first circle on one side of the longitudinal axis and (b) the center point of a second circle on the opposite side of the longitudinal axis with both of the circles being cross-sections of said second toroid is about 1.15 inches; and (ix) the vertical distance between (a) a line which is tangent to said resting surface and (b) the center point of a circle which is a cross-section of said second toroid is about 0.97 inch.

With regards to this prior art container of FIGS. 4–6, during a heating cycle (FIG. 20A), the recessed portion in the bottom wall of the container changes from being concave to convex when the net internal pressure is about 3.5 psi and the container volume is about 108% of the original container volume. During the cooling cycle (FIG. 20B) the bottom wall returns to its original concave configuration in two stages, the first of which occurs when the internal pressure is about 5.5 psi and the container volume is about 108% of the original volume, and the second stage occurs when the internal pressure is about 4 psi, and the container volume is about 105% of the original volume.

This prior art container in a 4 ounce size has been successfully used on a commercial basis by ross Laboratories, a Division of Abbott Laboratories U.S.A. for packaging infant formula. However; the tolerance for processing variables during the retort procedure is fairly tight. Also, in order to facilitate greater tolerances for processing variables the depth of the recessed portion in the bottom wall would need to be increased to such an extent that the plastic container could no longer be manufactured using a two-piece mold. The depth of the recessed portion could be increased using a more expensive three-piece mold in which the bottom wall is formed by one piece of the mold and the remainder of the container is formed by two other pieces of the mold.

With regards to the container presented in FIGS. 11–13, during the heating cycle (FIG. 20A) there is a snap-through of the recessed portion of the bottom wall of the container from concave to convex at an internal pressure of about 2.5 psi and a container volume of about 106% of original volume. During the cool-down cycle (FIG. 20A) the recessed portion of the bottom wall of the container has a return snap-through at an internal pressure of about 6 psi and a container volume of about 108% of original volume. The problem with this plastic container is that it does not eliminate snap-through. In the container simulated the large ellipse defined by outside corner 42 had an aspect ratio of about 1.7, and the smaller ellipse defined by inside corner 43 also had an aspect ratio of about 1.7.

A container according to the present invention, as shown in FIGS. 14–16 performs very well by virtually eliminating snap-through of the recessed portion of the bottom wall during both the heating cycle (FIG. 20A) and the cooling cycle (FIG. 20B) of a retort procedure. The advantages of a container according to the present invention are that it can be manufactured using a two-piece mold and it will tolerate a wider range of retort operating variables, which should reduce the occurrence of containers which do not have substantially the same configuration both before and after the retort process. That is to say, the occurrence of catastrophic failures of containers at a desired tolerance of processing variables, should be lower with the plastic containers of the present invention than for the prior art plastic containers. The aspect ratio of the non-circular secondary recessed region of the bottom wall of the plastic container of FIGS. 14–16 is about 1.21.

The outside surface bottom wall of this container of the present invention had the following dimensions, in inches, (as described above with reference to FIGS. 14–16):

A=1.71
B=1.15
C=0.94
D=0.14
E=0.10
F=0.26
G=1.71
RS1=0.14
RS2=0.14

It is to be noted however, that there are physical limitations on the configuration of the recessed portion of the bottom wall of a plastic container wherein the outside corner defines a circular primary recessed portion and the inside corner defines a non-circular secondary recessed portion when the bottom wall of the container is viewed head-on. For example, the container shown in FIGS. 17–19 has a snap-through during the heating cycle (FIG. 20A) at an internal pressure of about 2.5 psi and a volume of about 105% of the original volume. During the cooling cycle (FIG. 20B) the reverse snap-through occurs of an internal pressure of about 2.5 psi and a volume of about 105% of the original volume. The aspect ratio of the non-circular secondary recessed portion of the bottom wall of the plastic container of FIGS. 17–19 is about 3.08. Based upon this computer simulated performance it is believed to be critical that the aspect ratio of the non-circular region of the recessed portion of the bottom wall of the plastic container should be greater than 1 but not greater than 3.

The outside surface of bottom wall of this simulated container had the following dimensions, in inches, (as described above with reference to FIGS. 14–16):

A=1.71
B=1.15
C=0.37
D=0.14
E=0.12
F=0.26
G=1.71
RS1=0.14
RS2=0.14

Figure 22:
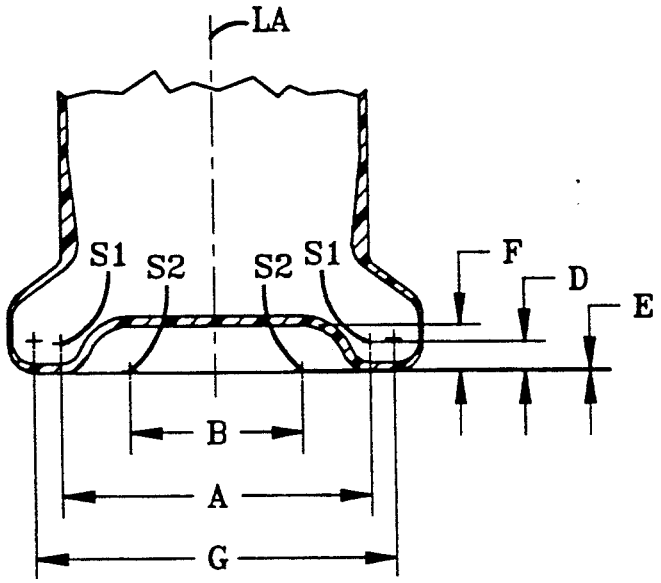
FIGS. 21–45 present several embodiments of plastic containers according to the present invention.
Figure 21:
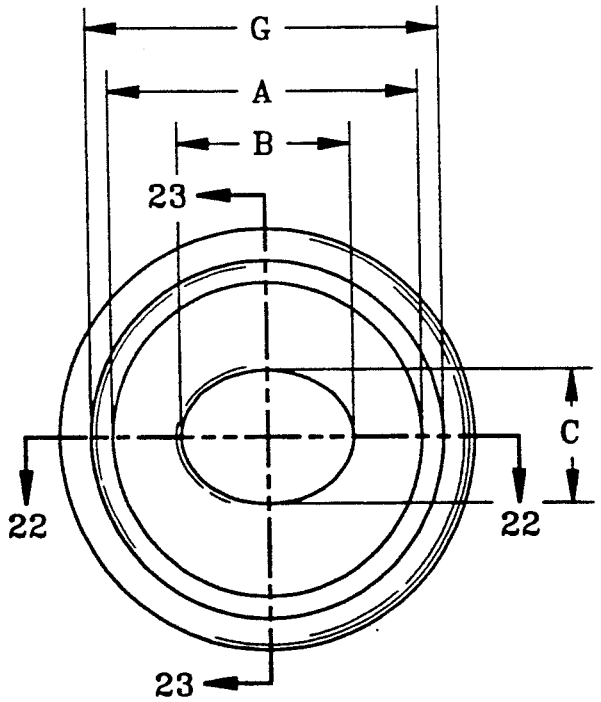
Figure 23:
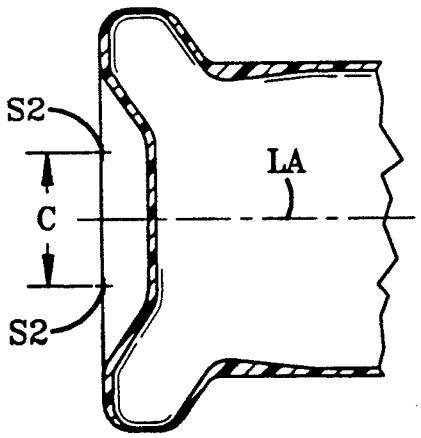

Referring next to FIGS. 21–23 there is shown the base portion of a preferred embodiment of a plastic container according to the present invention. This container has substantially the same size, shape and configuration as the prior art container of FIGS. 1–3 distinguished by having a bottom wall according to the present invention. That is to say in a preferred embodiment of the present invention a plastic container has an overall height of about 4.2 inches, a maximum outside diameter of about 1.76 inches in the base portion, an outside diameter of about 1.32 inches in the main body portion, and has a capacity of about two fluid ounces. The embodiment is a high panel strength container (a panel strength of greater than 2.54 p.s.i.) In this preferred embodiment the container is made of the materials which are described in the foregoing written description of the prior art container of FIGS. 1–3. In the preferred embodiment the secondary recessed portion of the bottom wall of the container has an aspect ratio (B/C) of about 1.3, and the other dimensions of the outside surface of the bottom wall, in inches, (as described above with reference to FIGS. 14–16) are:

A=1.31
B=0.73
C=0.56
D=0.13
E=0.01
F=0.26
G=1.15
RS1=0.13
RS2=0.19

Figure 25:
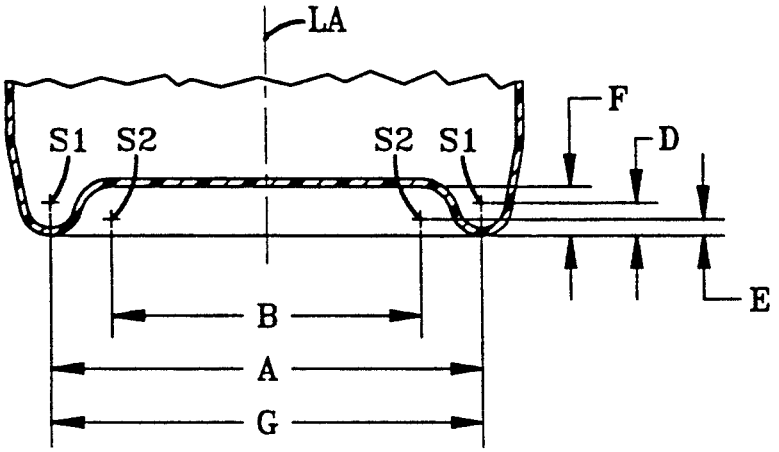
Figure 24:
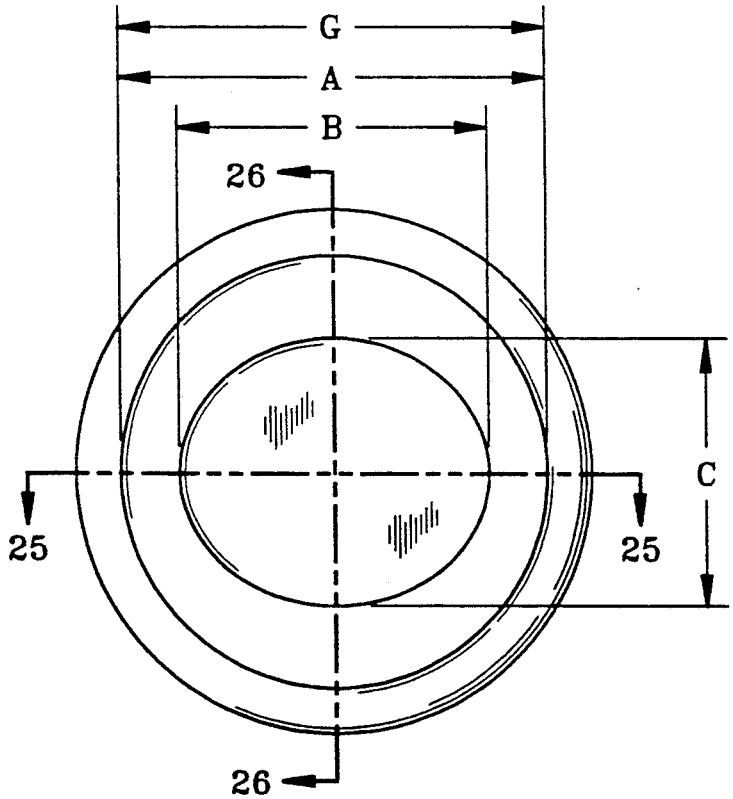
Figure 26:
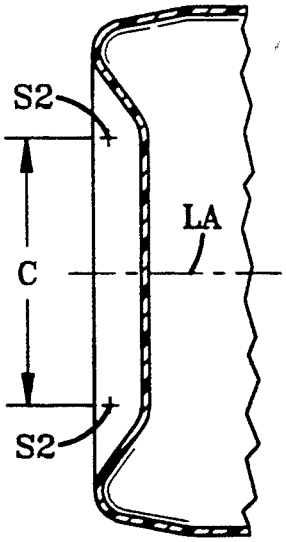
Figure 29:
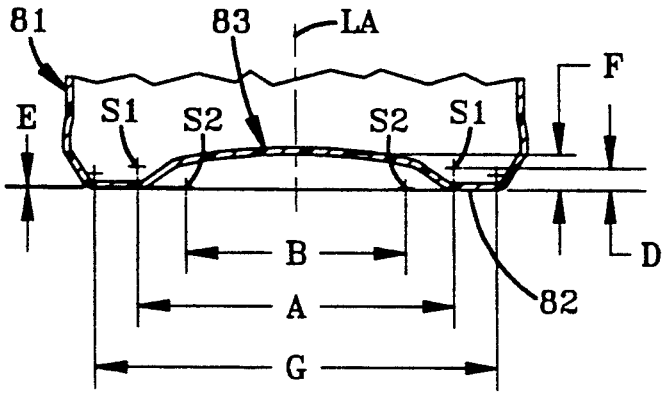
Figure 27:
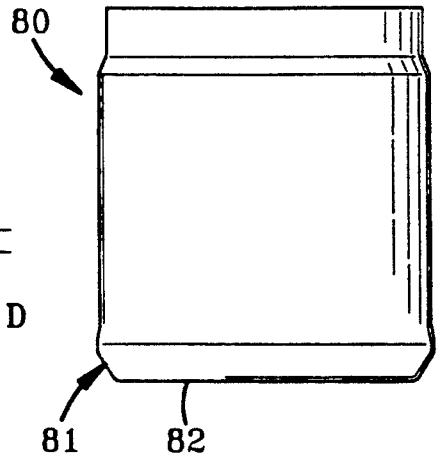
Figure 28:
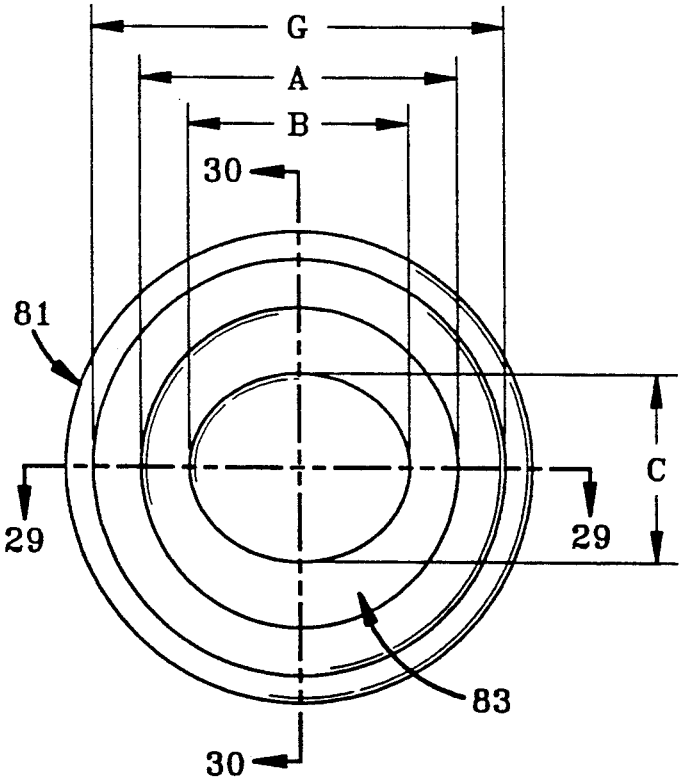
Figure 30:
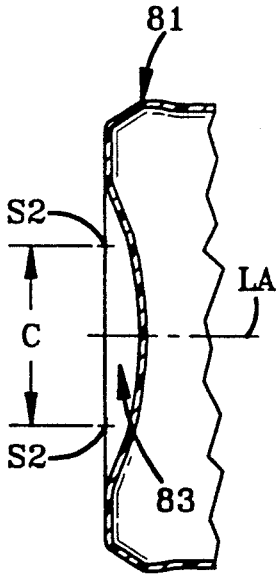

Referring next to FIGS. 24–26 there is shown the base portion of another preferred embodiment of a plastic container according to the present invention. This container has substantially the same size, shape and configuration as the prior art container of FIGS. 4–6, distinguished by having a bottom wall according to the present invention. That is to say in a preferred embodiment of the present invention a plastic container has an overall height of about 3.37 inches, a maximum diameter of about 2.05 inches and a capacity of about four fluid ounces. This embodiment is a high panel strength container (panel strength greater than 2.54 p.s.i.) Again, this preferred embodiment is made of the materials which are described in the foregoing description of the prior art container of FIGS. 1–3. In this preferred embodiment the secondary recessed portion of the bottom wall of the container has an aspect ration (B/C) of about 1.2, and the other dimensions of the outside surface of the bottom wall, in inches, (as described above with reference to FIGS. 14–16) are:

A=1.71
B=1.23
C=1.05
D=0.13
E=0.06
F=0.19
G=1.71
RS1=0.13
RS2=0.13

Referring next to FIGS. 27–30 there is shown a plastic container 80 in accordance with another embodiment of the present invention. This embodiment is a low panel strength container (a panel strength of equal to or less than 2.54 p.s.i.) having an overall configuration commonly referred to as a can. The base portion 81 of this container has a bottom wall 82 having a recessed portion 83 therein. Such a container may be made of any suitable plastic material(s) including those described above with respect to FIGS. 1–3. The secondary recessed portion of the bottom wall of this plastic container, which in this example has a capacity of about eight fluid ounces, has an aspect ratio (B/C) of about 1.2, and the other dimensions of the outside surface of the bottom wall, in inches, (as described above with reference FIGS. 14–16) are:

A=1.83
B=1.27
C=1.08
D=0.13
E=0.01
F=0.20
G=2.32
RS1=0.13
RS2=0.13

Figure 32:
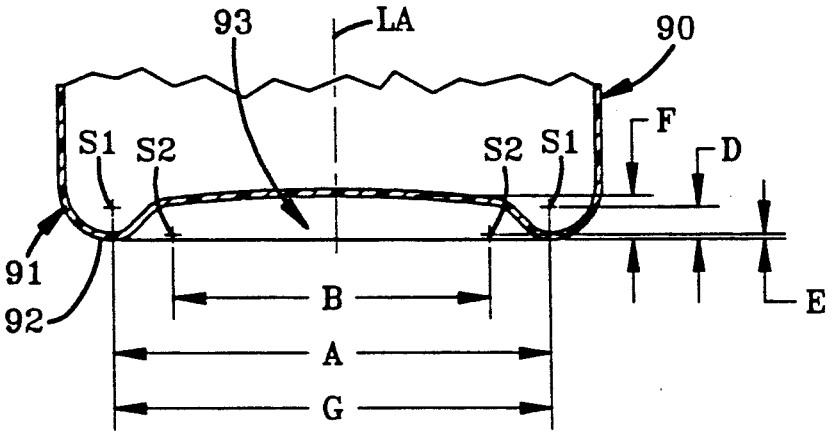
Figure 31:
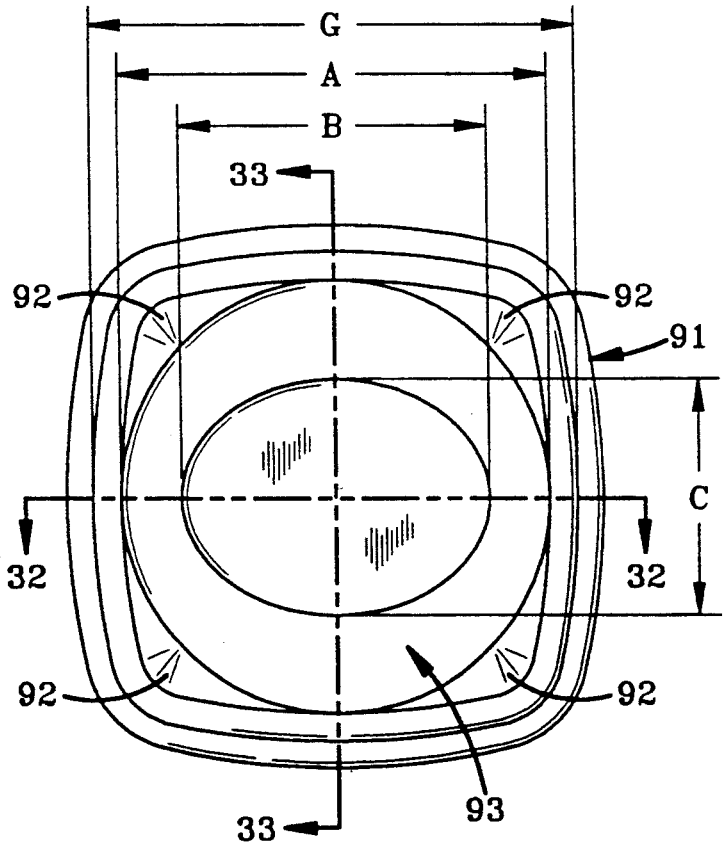
Figure 33:
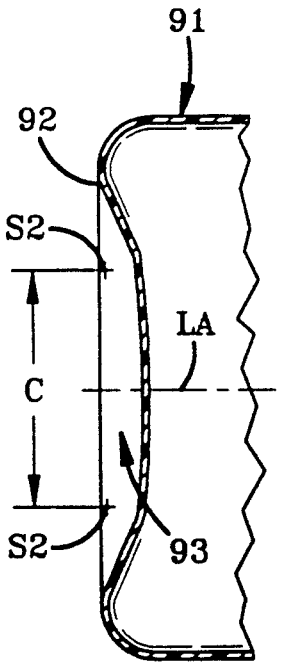

Referring next to FIGS. 31–33 there is shown the base portion 91 of a plastic container 90 having the general size, shape and configuration of the prior art plastic container shown in FIGS. 7–10, distinguished by having a bottom wall 92 according to the present invention. While a means for hanging the container in an inverted position is not shown in FIGS. 31–33 (as is shown in FIGS. 8–10), it is understood that a plastic container in accordance with the invention may include integral therewith a means for hanging the bottle in an inverted position. Such a container may have either a high or low panel strength, and be manufactured of any suitable plastic material(s) including those described above with respect to FIGS. 1–3. The secondary recessed portion of the bottom wall of this plastic container, which in this example has a capacity of about one liter, has an aspect ratio (B/C) of about 1.3, and the other dimensions of the outside surface of the bottom wall, in inches (as described above with reference to FIGS. 14–16) are:

A=2.75
B=1.98
C=1.50
D=0.20
E=0.02
F=0.27
G=2.75
RS1=0.20
RS2=0.20

Referring to FIGS. 34–45 there are shown a variety of base portions according to the present invention which are useable with plastic containers of the general size, shape and configuration of the prior art container shown in FIGS. 4–6. While in the foregoing exemplary embodiments of the present invention the secondary recessed portion has a substantially elliptical appearance when the bottom wall of the container is viewed head-on, the embodiments of FIGS. 34–45 illustrate, but do not limit, other shapes of secondary recessed portions which are believed to be suitable for use in the practice of the present invention.

Figure 35:
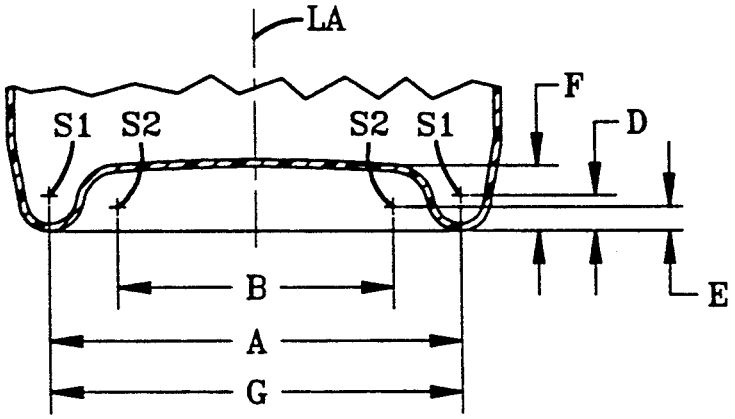
Figure 34:
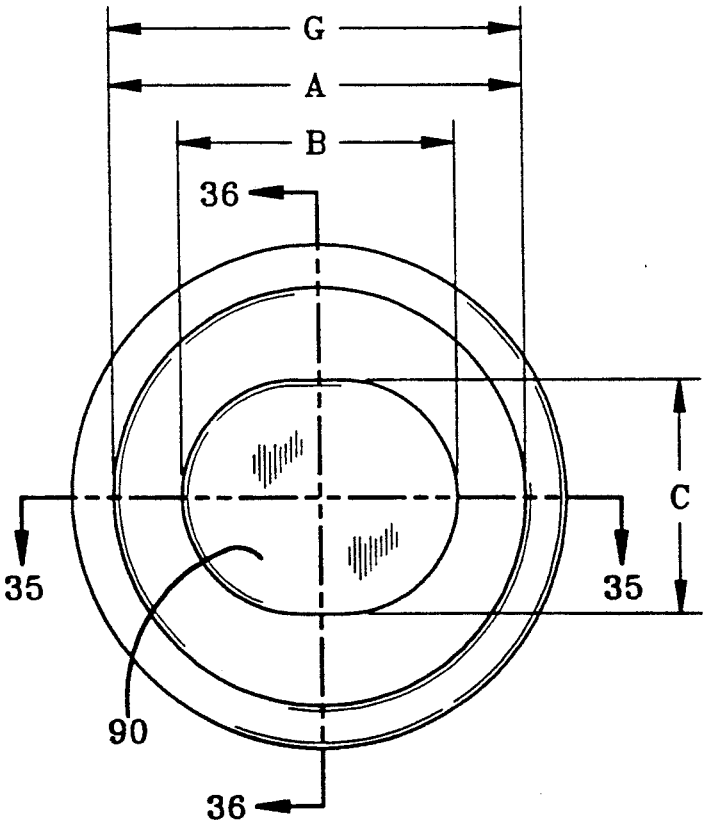
Figure 36:
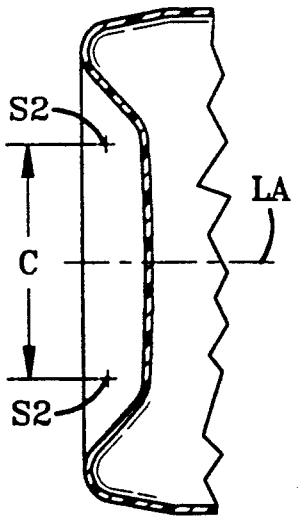
Figure 38:
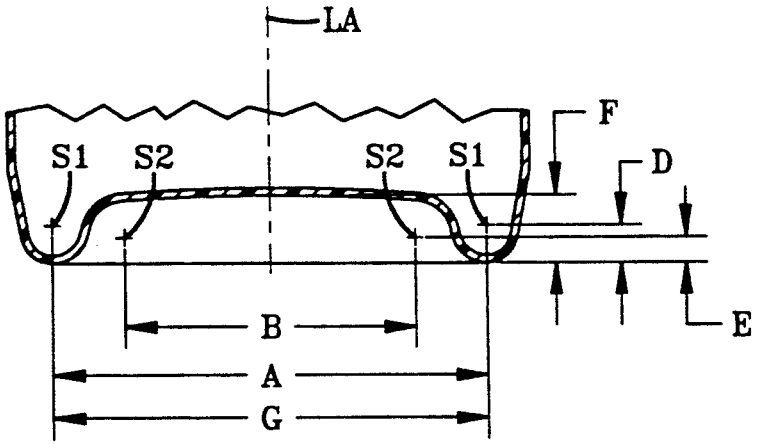
Figure 37:
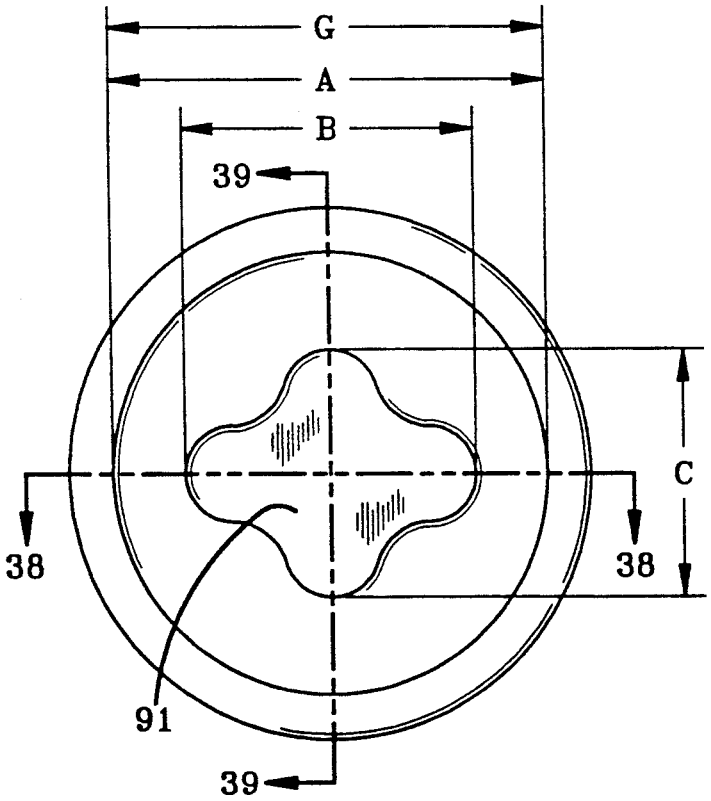
Figure 39:
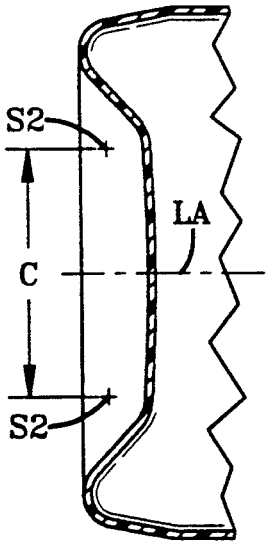
Figure 41:
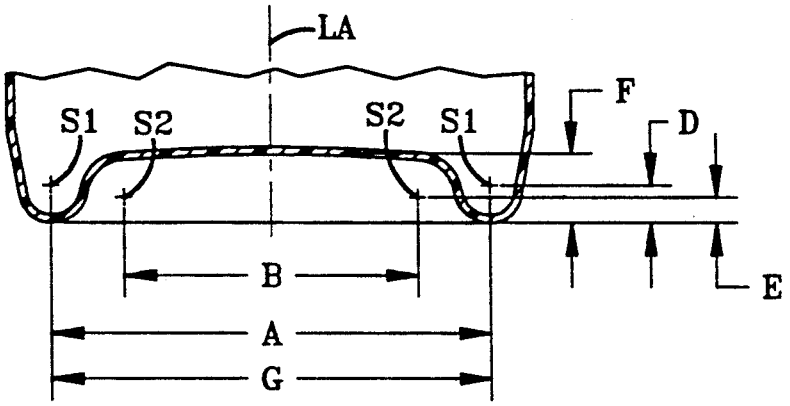
Figure 40:
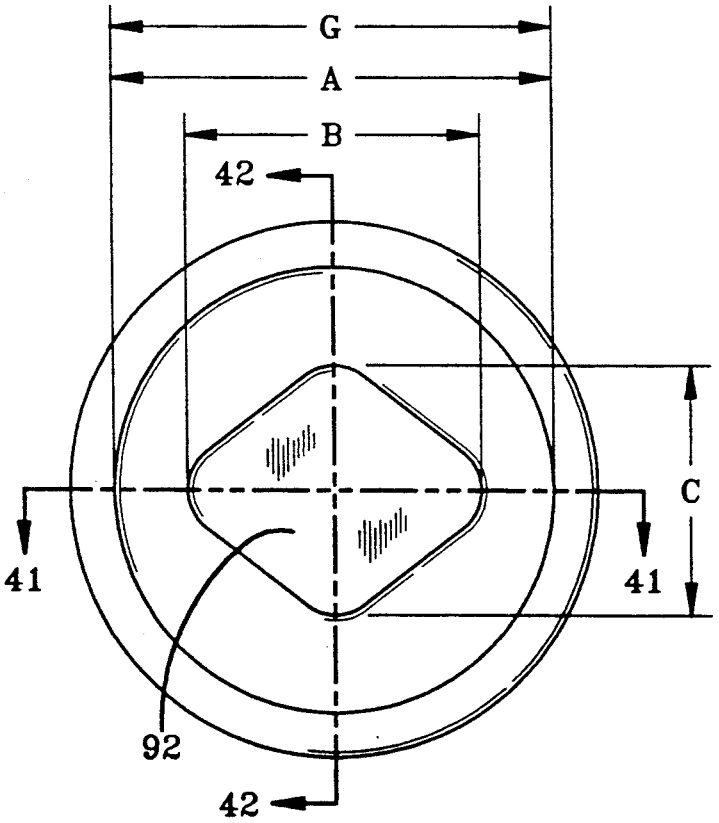
Figure 42:
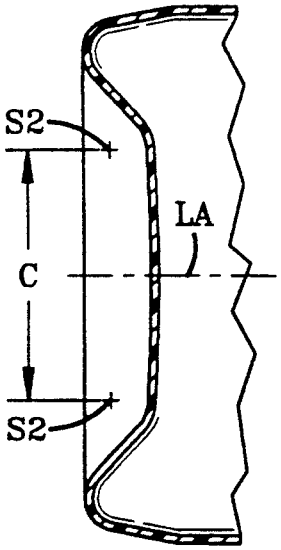

In the embodiment shown in FIGS. 34–36 the secondary recessed portion 90 of the bottom wall of the container has a "racetrack" shape when viewed head-on as shown in FIG. 34. In the embodiment shown in FIGS. 37–39 the secondary recessed portion 91 of the bottom wall of the container has a "+" shape when viewed head-on as shown in FIG. 37. In the embodiment shown in FIGS. 40–42 the secondary recessed portion 92 of the bottom wall of the container has a "diamond" shape when viewed head-on as shown in FIG. 40. It is to be noted that in all embodiments of the present invention the secondary recessed portion of the bottom wall of the container, when viewed head-on, should be free of sharp corners which would concentrate stresses during a retort procedure. For the embodiments of FIGS. 34–42 the aspect ratio (B/C) of the secondary recessed portion of the bottom wall of the container is about 1.3, and the other dimensions of the outside surface of the bottom wall, in inches, for a container having a capacity of about four fluid ounces, (as described above with reference to FIGS. 14–16) are:

A=1.71
B=1.15
C=0.86
D=0.14
E=0.10
F=0.29
G=1.71
RS1=0.14
RS2=0.14

Figure 44:
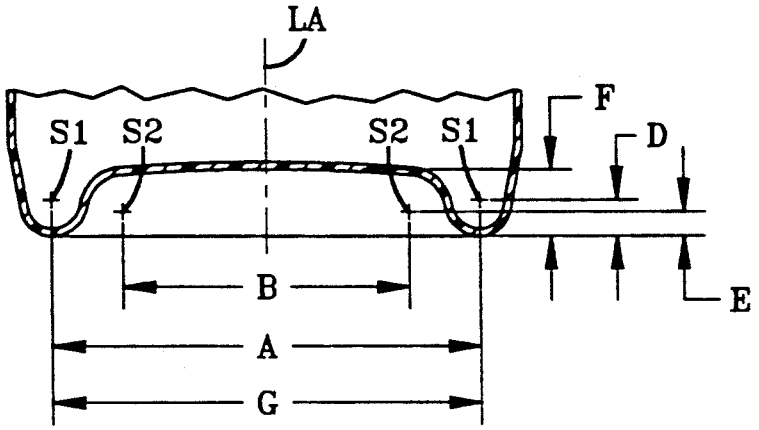
Figure 43:
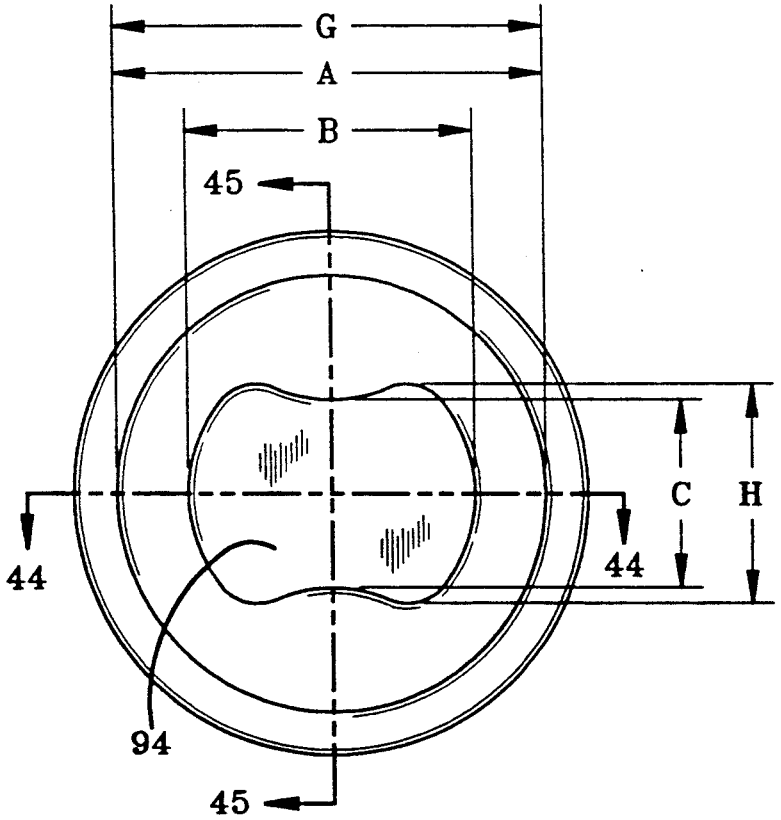
Figure 45:
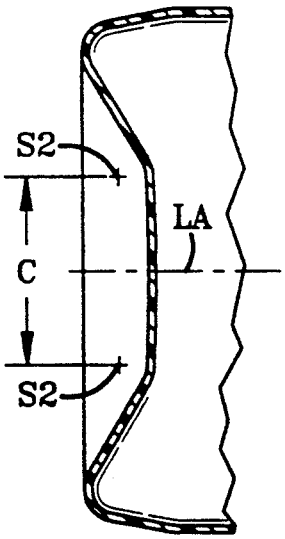

Referring to the embodiment shown in FIGS. 43–45 the secondary recessed portion 94 in the bottom wall of the container has a "bow-tie" shape when the bottom wall is viewed head-on as in FIG. 43. In this embodiment the greatest extent H of the secondary recessed portion taken perpendicular to its major axis is not located on the minor axis of the secondary recessed portion. In such an embodiment B/H should not exceed 3, while B/C should be at least 1. The dimensions of the outside surface of the bottom wall are the same as those presented above with regards to FIGS. 34–42, with the exceptions that C is about 0.72 inch (giving an aspect ratio of B/C of 1.6), and the additional stipulation that H is about 0.86 inch.

Containers according to the present invention may comprise a variety of shapes, a variety of plastics and may be manufactured by a variety of manufacturing methods. Therefor; a bottom profile of the type disclosed herein should be selected by a designer or engineer to be compatible with the plastic(s) and manufacturing method employed for a particular container in accordance with good engineering practices.

While certain representative embodiments and details have been presented for the purpose of illustrating the invention, it will be apparent to those skilled in the art that various changes and modification may be made therein without deporting from the spirit or scope of the invention.

I claim:

1. A retortable plastic container capable of being subjected to a peak sterilization temperature in the range of about 120° C. to about 130° C. without catastrophic failure, said container comprising at least one sidewall and a bottom wall which are formed together as a single piece, said bottom wall having an exterior surface with the lowermost portion thereof being a resting surface which extends circumferentially about a primary recessed portion of the bottom wall of the container, said primary recessed portion of the bottom wall having a circular outline when said bottom wall of the container is viewed head-on and has a center located on a longitudinal axis of the container, said primary recessed portion surrounding a secondary recessed portion of the bottom wall of the container, said secondary recessed portion having a non-circular outline when said bottom wall of the container is viewed head-on, said secondary recessed portion having major and minor axes which are mutually perpendicular and intersect one another on the longitudinal axis of the container, said major axis including the greatest linear dimension across the secondary recessed portion when the bottom wall of the container is viewed head-on, and said secondary recessed portion having an aspect ratio which is the distance thereacross along said major axis divided by the distance thereacross along said minor axis when the bottom wall of the container is viewed head-on, said aspect ratio being greater than 1 but not greater than 3.

2. A retortable plastic container as described in claim 1 wherein the plastic container is formed by extrusion blow molding in a two-piece mold and the major axis of the secondary recessed portion of the bottom wall of the container is coincident with a parting line of said two-piece mold.

3. A retortable plastic container as described in claims 1 wherein the container comprises only a single plastic material.

4. A retortable plastic container as described in claim 2 wherein the container comprises only a single plastic material.

5. A retortable plastic container as described in claim 1 wherein the container comprises at least two layers of different plastic materials.

6. A retortable plastic container as described in claim 2 wherein the container comprises at least two layers of different plastic materials.

7. A retortable plastic container as described in any one of claims 1–6 wherein the greatest distance across said secondary recessed portion when the bottom wall of the container is viewed head-on is located at said minor-axis.

8. A retortable plastic container as described in any one of claims 1–6 wherein said secondary recessed portion has an outline which is elliptical when the bottom wall of the container is viewed head-on.

9. A retortable plastic container as described in any one of claims 1–6 wherein the greatest distance across said secondary recessed portion measured perpendicular to said major axis when the bottom wall of the container is viewed head-on is located on each side of said minor axis, and the distance across the secondary recessed portion along the major axis divided by the greatest distance across the secondary recessed portion measured perpendicular to the major axis is greater than 1 but not greater than 3.

* * * * *

UNITED STATES PATENT AND TRADEMARK OFFICE

CERTIFICATE OF CORRECTION

PATENT NO. : 5,269,437

DATED : December 14, 1993

INVENTOR(S) : Gygax

It is certified that error appears in the above-identified patent and that said Letters Patent is hereby corrected as shown below:

Column 2, line 38, "18.5 kPa" should be --17.5 kPa--.

Column 4, line 27, "panel strength" should be --high panel strength--.

Column 13, line 45, "ross" should be --Ross--.

Signed and Sealed this

Twelfth Day of July, 1994

*Attest:*

Bruce Lehman

BRUCE LEHMAN

*Attesting Officer*

*Commissioner of Patents and Trademarks*